United States Patent [19]

Dick et al.

[11] Patent Number: 4,648,014

[45] Date of Patent: Mar. 3, 1987

[54] HEADLIGHT OR LAMP FOR VEHICLES

[75] Inventors: Heinz Dick, Odenthal; Johannes Lux, Cologne, both of Fed. Rep. of Germany

[73] Assignee: Ford Motor Company, Dearborn, Mich.

[21] Appl. No.: 719,859

[22] Filed: Apr. 4, 1985

[51] Int. Cl.[4] ..... F21V 7/00

[52] U.S. Cl. ..... 362/346; 362/297

[58] Field of Search ..... 362/226, 346, 341, 296, 362/64, 61, 80, 297

[56] References Cited

U.S. PATENT DOCUMENTS

| | | | |
|---|---|---|---|
| 1,148,942 | 8/1915 | Wilson | 362/346 |
| 1,424,525 | 8/1922 | Seely | 362/346 |
| 4,255,781 | 3/1981 | Plemmon et al. | 362/375 |
| 4,261,029 | 4/1981 | Monsset | 362/346 |
| 4,271,459 | 6/1981 | James | 362/346 |
| 4,338,655 | 7/1982 | Gulliksen et al. | 362/346 |
| 4,470,103 | 9/1984 | Krieg | 362/346 |

FOREIGN PATENT DOCUMENTS

| | | | |
|---|---|---|---|
| 1937301 | 2/1971 | Fed. Rep. of Germany . | |
| 2024171 | 8/1974 | Fed. Rep. of Germany . | |
| 2002935 | 7/1977 | Fed. Rep. of Germany . | |
| 2755200 | 6/1979 | Fed. Rep. of Germany . | |
| 3045232 | 6/1982 | Fed. Rep. of Germany | 362/346 |
| 345174 | 3/1931 | United Kingdom | 362/346 |

*Primary Examiner*—Charles J. Myhre
*Assistant Examiner*—David A. Okonsky
*Attorney, Agent, or Firm*—Paul K. Godwin, Jr.; Clifford L. Sadler

[57] ABSTRACT

An improved headlight or lamp assembly for vehicles which incorporates a lens element bonded to a first reflector element. The first reflector element contains a vertically oriented slot centrally located to receive and retain a second reflector element. The second reflector element is a one piece metal stamping that conforms to the curvature of the first reflector element at its slot and contains a socket for retaining a bulb. Removal and replacement of the bulb is therefore achievable by moving the second reflector element in directions that are transverse to the optical axis of the lamp assembly.

1 Claim, 3 Drawing Figures

HEADLIGHT OR LAMP FOR VEHICLES

BACKGROUND

1. Field of the Invention

The present invention relates to a vehicle headlight or lamp that utilizes a removable bulb and socket.

2. Description of the Prior Art

A spotlight and fog lamp for vehicles can be seen in German Offenlegungsschrift No. 19 37 301 and Patentschrift No. 20 24 171 respectively, but these can only remotely be regarded as the starting point for the present invention. These known lights or lamps concern accessories which are fitted on a vehicle after its sale. When a bulb change is necessary in the case of the '301 device the entire light must be disassembled. In the case of the '171 device, the front lens has to be removed.

In German Patentschrift No. 20 02 935, a lamp assembly is shown where a lens and reflector are attached to a support frame. Both the reflector and the lens are attached to the support frame by a spring assembly so that they can easily be removed from the support frame in the direction of the optical axis of the lamp, in order to change the bulb.

In German Offenlegungsschrift No. 27 55 200 a metal bulb socket is shown mounted in a plastic reflector and is so designed that it dissipates the heat produced by the bulb. Changing the bulb is only possible by removing the rear housing in the direction of the optical axis of the light.

With modern vehicles, the fitting of powerful headlights is becoming more and more difficult through the increasingly aerodynamic taper of the hood and the lack of space in the engine compartment that results therefrom. In the case of comparatively wide European style headlights which lie partly in front of the radiator area, access for changing the bulb is only possible through the lens or from above. Headlights which utilized top mounted bulbs were therefore provided with asymmetric reflectors in which the bulb was top mounted so as to be suspended. This produced shadows and dark spots and resulted in an inferior lighting technique and less powerful headlights.

A further disadvantage of the suspended top mounted bulbs is due to a high temperature concentration in the region of the bulb socket, thereby preventing the use of low cost plastic materials for the reflector.

SUMMARY OF THE INVENTION

The object of the present invention is to provide a headlight or lamp assembly for vehicles which allows a horizontal arrangement of the bulb and in addition allows the bulb to be inserted and removed in directions perpendicular to the optical axis of the light. Furthermore, a favorable heat conduction around the bulb socket is provided so that low cost plastic material can be used for the major part of the reflector.

The reflector of the headlamp invention described herein comprises a first fixed reflector portion and a second displaceable reflector portion. The second reflector portion contains a bulb socket wherein a high intensity bulb is mounted centrally and horizontally and can be removed in a direction which runs transverse to the optical axis of the light. This provides a headlight that may be designed to have low structural height with a bulb that can be easily changed.

The first reflector portion is formed of plastic material and the second reflector portion is formed of metal.

The metal is in one piece and has a bulb socket formed therein to provide effective heat conduction.

The first reflector portion forms a parallel-walled vertically oriented slot into which the second reflector portion can be inserted in a direction that is generally orthogonal to the optical axis of the light, guided by suitable side pieces. A secure alignment of the second reflector portion is ensured.

The second reflector portion contains a stepped portion in the area surrounding the socket opening. The stepped portion projects slightly forward with respect to the rear of the reflector and allows for an even flatter structural height of the headlight to be achieved.

In addition, the displaceable second reflector portion is retained in a fixed position within the first reflector portion by the flat bladed plug-in contacts of the electrical connecting leads. These leads, which are disconnected when changing the bulb, normally remain in the housing so as not to cause obstruction when removing the second reflector portion across the axis of the light.

The invention will now be explained with reference to the embodiment illustrated in the accompanying drawings in which:

DETAILED DESCRIPTION OF THE PREFERRED EMBODIMENT

Figure 1:
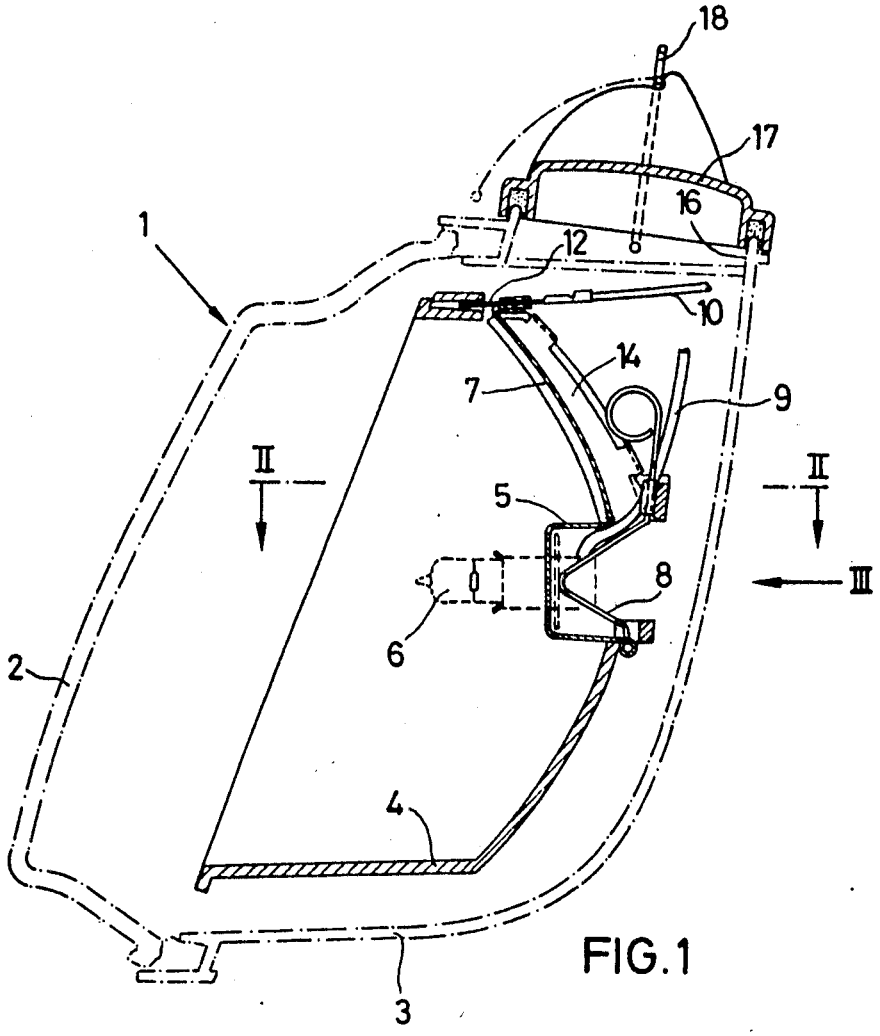
FIG. 1 is a vertical section view in the longitudinal direction of the vehicle through a headlight assembly according to the present invention.
Figure 2:
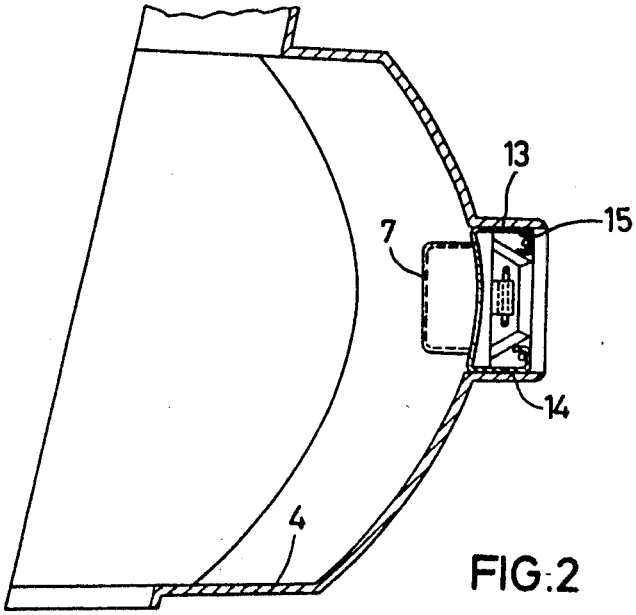
FIG. 2 is a horizontal section view taken along the line II—II in FIG. 1.
Figure 3:
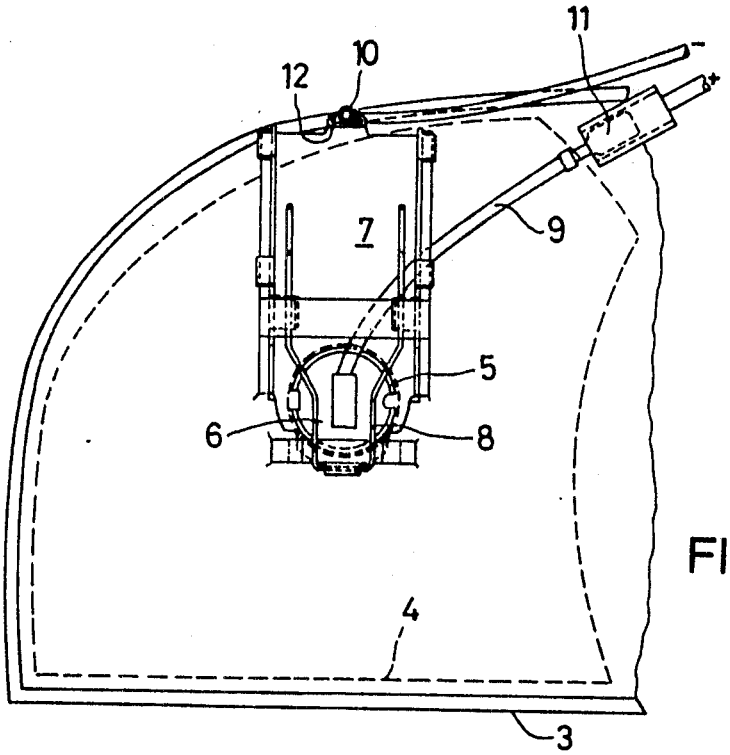
FIG. 3 is a rear view in the direction of arrow III in FIG. 1.

The headlight assembly 1, shown in the drawings, an also be configured to function as a spotlight, fog headlight or fog lamp. The assembly basically comprises a lens 2 and a support housing 3 which are connected together and fixed to the body of the associated vehicle (not shown). A first fixed reflector portion 4 is formed of a plastic material coated with a reflective material. A second displaceable reflector portion 7 is shown mounted onto the first reflector portion 4. The second displaceable reflector portion 7 is preferably formed from a sheet metal stamping to have a bulb socket opening 5. A bulb 6 is shown in shadow lines mounted in the socket 5. A retaining spring 8 is provided in the conventional way for holding the bulb 6 in the bulb socket. Leads 9 and 10 with corresponding flat blade plug-in contacts 11 and 12 provide electrical connection of the bulb 6 at the socket 5 and the ground to the second reflector portion 7.

The displaceable second reflector portion 7 is formed to have a stepped portion set forward relative to the rearward most part of the first reflector portion 4 and has rearwardly extending parallel side pieces 13 and 14 which are guided in a parallel-walled vertical slot 15 of the first reflector part 4.

The housing 3 is provided in the area above the second displaceable reflector portion 7 with an opening 16 Which is closed by a sealed cap 17 in conjunction with a spring bar 18.

In order to replace the bulb, the spring bar 18 must first be released by rotating it forward. The cap is then removed and the flat plug-in connections 12 and 11 of the leads 10 and 9 are respectively released. The disconnection of the flat bladed connection 12 of lead 10 releases the displaceable second reflector portion 7 so that it may be withdrawn through the upper opening 16. The bulb 6 can be replaced in the withdrawn second reflector portion 7 by releasing the retaining spring 8.

Refitting the second reflector portion 7 from above is not difficult, since its parallel side pieces 13 and 14 in conjunction with the parallel-walled slot on the first reflector part 4 ensure a good guide. When the second reflector portion 7 is fully inserted to its rest position the flat bladed plug-in contacts 12 and 11 are connected to respectively secure the position of the second reflector portion 7 and provide the electric connection for the bulb socket 5.

The second displaceable reflector portion 7 allows the headlight to be easily adapted to different national laws. For instance, where a yellow light is required, such as for example in France, either a yellow filter can be attached to the second reflector portion or the aluminum cover of the second reflector portion can be provided with a yellow protecting varnish. By suitably selecting the size of the second reflector portion in relation to the first reflector portion, the main structural unit of the headlight can remain the same and only a different second reflector part need by provided for different national requirements.

The use of a second reflector portion which can be removed across the optical axis of the light is not only useful for spot and fog lights but can also be used for headlight installation.

We claim:

1. In a vehicle lamp assembly which includes a lens element, a first reflector element attached to said lens element and a light emitting bulb attached to the first reflector element opposite to said lens element at a position between said reflector element and said lens element to establish an optical axis to extend through said bulb and said lens, an improvement comprising:

said first reflector element containing a slotted opening with parallel side walls extending from the approximate center of said reflector element towards an outer edge transverse to said optical axis;

a second reflector element containing a socket for retaining said light emitting bulb, said second reflector element is formed to be insertable into said parallel walled slot of said first reflector so as to generally conform to complete the reflective surface across said slot and to be removable with said light emitting bulb in said transverse direction.

* * * * *